US007726600B2

(12) United States Patent
Huang

(10) Patent No.: US 7,726,600 B2
(45) Date of Patent: Jun. 1, 2010

(54) STRETCH FILM DISPENSER

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 128 days.

(21) Appl. No.: 12/025,361

(22) Filed: Feb. 4, 2008

(65) Prior Publication Data

US 2009/0194629 A1 Aug. 6, 2009

(51) Int. Cl.
*B65H 16/04* (2006.01)

(52) U.S. Cl. ..... 242/588.2; 242/597.6

(58) Field of Classification Search ..... 242/588.2, 242/588, 597.6, 405.3
See application file for complete search history.

(56) References Cited

U.S. PATENT DOCUMENTS 3,275,257 A * 9/1966 Cherniavskyj ..... 242/611.2
4,872,623 A * 10/1989 Parry et al. ..... 242/422.4
6,102,323 A * 8/2000 Riemenschneider ..... 242/422.4
6,227,480 B1 * 5/2001 Huang ..... 242/588.2
6,651,918 B2 * 11/2003 Huang ..... 242/423.1
6,892,975 B2 * 5/2005 Yu Chen ..... 242/422.4
7,210,649 B2 * 5/2007 Yu Chen ..... 242/588.2
7,552,891 B2 * 6/2009 Huang ..... 242/588.2
2006/0237577 A1 * 10/2006 Chen ..... 242/588

* cited by examiner

*Primary Examiner*—John Q Nguyen
*Assistant Examiner*—William E Dondero
(74) *Attorney, Agent, or Firm*—Browdy and Neimark, PLLC

(57) ABSTRACT

The present invention provides a stretch film dispenser, which includes a base, a reel device, and a brake device. The reel device has a reel and a connecting member pivotally connected to the base, and the brake device is connected to the base and is fitted to the connecting member of the reel device. The base and the brake device form a holding member of the stretch film dispenser to be grasped by an operator. The present invention further provides a second reel to be fitted to the reel of the reel dispenser to dispense the stretch film rolls with different core diameter.

17 Claims, 5 Drawing Sheets

STRETCH FILM DISPENSER

BACKGROUND OF THE INVENTION

1. Field of the Invention

The present invention relates generally to a package tool, and more particularly to a stretch film dispenser.

2. Description of the Related Art

In package task, some will wrap stretch film around the products. Usually, operator will use two dispensers, so called "hand saver", mounted on opposite ends of the stretch film roll for the package task. Conventional stretch film dispensers include a base and a reel mounted on the base for free rotation. The reel may be inserted into the core of the stretch film roll that operator may hold the base to dispense the stretch film.

Such base has a cavity at a bottom thereof, which is a hollow portion of an axle for the reel. Operator inserts his/her fingers, except thumb, into the cavity to hold the dispenser. In Europe, the most common diameters of the cores of the stretch film roll are 1.5 inches and 2 inches. When aforesaid dispenser is made for such stretch film roll, the diameter of the cavity of the base may be is 1.5 inches or less that only allows one or two fingers inserted into the cavity. In other words, operator is unable to hold the conventional dispenser firmly when the dispenser is applied for 1.5 or 2 inches stretch film roll.

SUMMARY OF THE INVENTION

The primary objective of the present invention is to provide a stretch film dispenser, which may be held firmly no matter what scale it is.

According to the objectives of the present invention, a stretch film dispenser includes a ball-like holding member and a reel for free rotation relative to the holding member. An operator may grasp the holding member with a palm to operate the stretch film dispenser that the holding mode of the present invention will not be affected by the size of the reel.

DETAILED DESCRIPTION OF THE INVENTION

Figure 1:
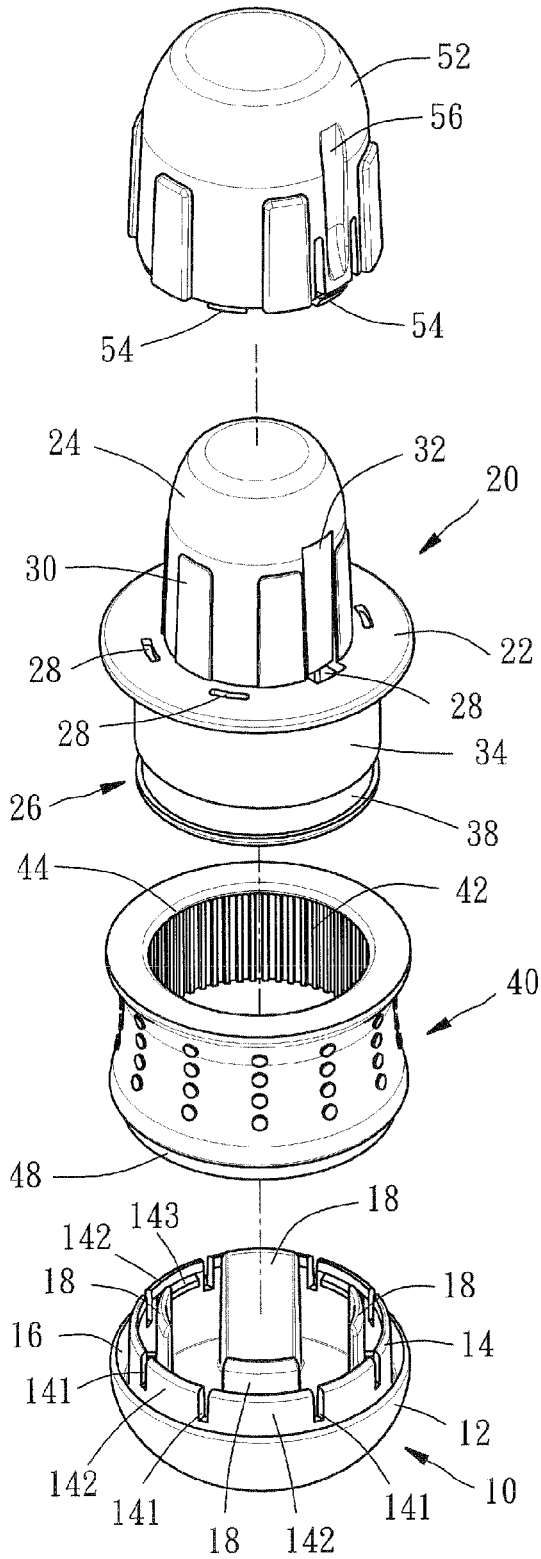
FIG. 1 is an exploded view of a preferred embodiment of the present invention.

As shown in FIG. 1, a stretch film dispenser of the embodiment of the present invention mainly includes a base 10, a reel device 20, a brake device 40, and a second reel 52.

The base 10 has a semi-spherical shell 12 and an annular wall 14 at an open end of the shell 12 to form an annular cavity 16 between the shell 12 and the wall 14. The annular wall 14 has a plurality of gaps 141 to form flexible plates 142 therebetween. Each flexible plate 142 has a hook 143 at an inner side thereof. The shell 12 further has four support plates 18 within the annular wall 14.

Figure 5:
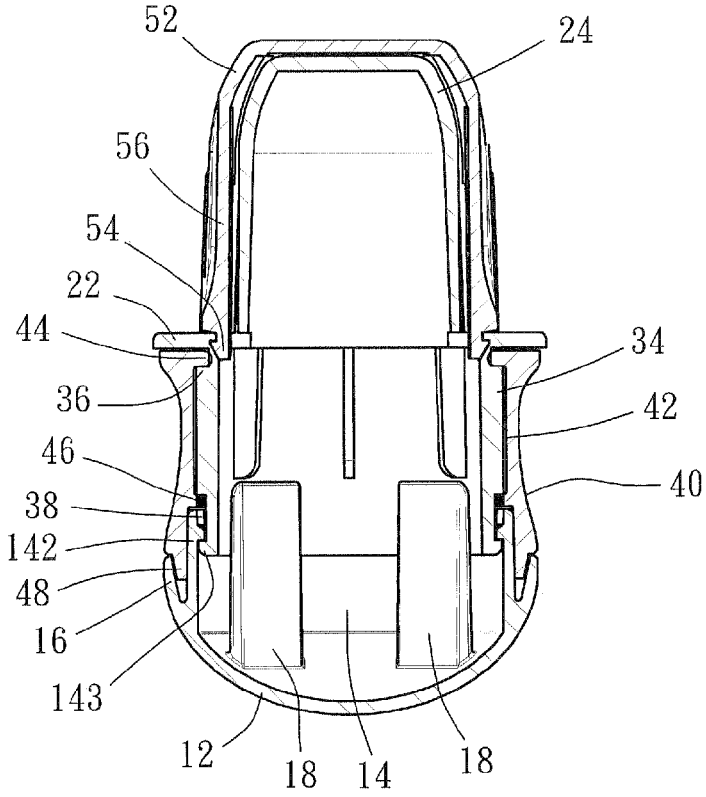
FIG. 5 is a sectional view of FIG. 4.

The reel device 20 has a rim 22 at a middle thereof and a reel 24 and a connecting member 26 at opposite sides of the rim 22. The rim 22 has a plurality of bores 28. The reel 24 has a plurality of ribs 30 and two indentations 32. Each indentation 32 has one of the bore 28 thereunder. The connecting member 26 has a friction portion 34 on an outer surface, and on opposite sides of the friction portion 34, there are two annular slots 36, 38. As shown in FIG. 5, the connecting member 26 of the reel device 20 is inserted into the base 12 between the annular wall 14 and the support plates 18 with the hooks 143 of the flexible plates 142 engaged with the slot 38 of the connecting member 26 that the reel device 20 may be connected the base 10 and may rotate freely.

The brake device 40 is a tubular member made of rubber or other soft plastics with high friction coefficient. On an outer side of the brake device 40 has grains, and on an inner side has a teeth-like texture 42 and two protrusions 44, 46 at opposite sides of the texture 42. On a bottom of the brake device 40 is a tapering bonding portion 48. The brake device 40 is fitted to the connecting member 26 with the bonding portion 48 inserted into the cavity 16 of the base and with the protrusions 44, 46 engaged with the slots 36, 38 of the reel device 20. The slot 38 is wider enough to receive both of the protrusion 46 of the brake device 40 and the hook 143 of the base 10. The texture 42 of the brake device 40 faces the friction portion 34 of the reel device 20. An outer diameter of the annular wall 14 is greater than an inner diameter of the brake device 40 that the brake device 40 is bonded to the base 10 and can not rotate with the reel device 20. As a result, the stretch film dispenser of the present invention has a ball-like (or door-knob-like) holding member 50, which consists of the base 10 and the reel 24, which may rotate freely.

Figure 2:
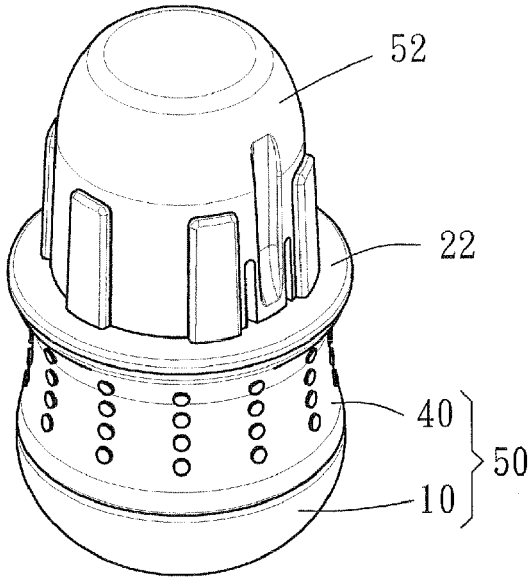
FIG. 2 is a perspective view of the preferred embodiment of the present invention, showing the second reel mounted.
Figure 3:
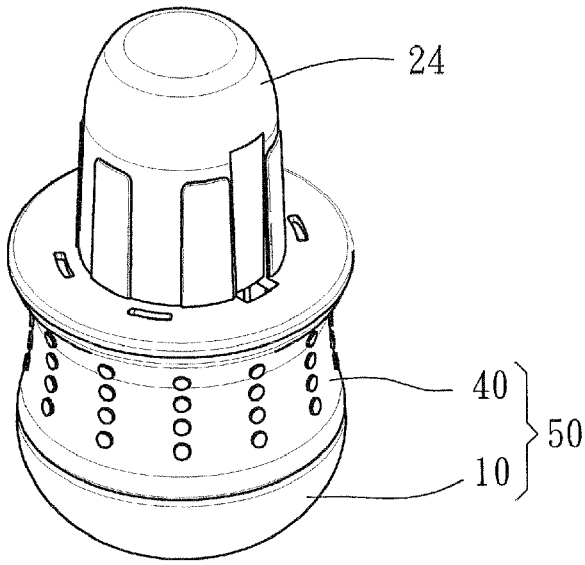
FIG. 3 is a perspective view of the preferred embodiment of the present invention, showing the second reel disassembled.
Figure 4:
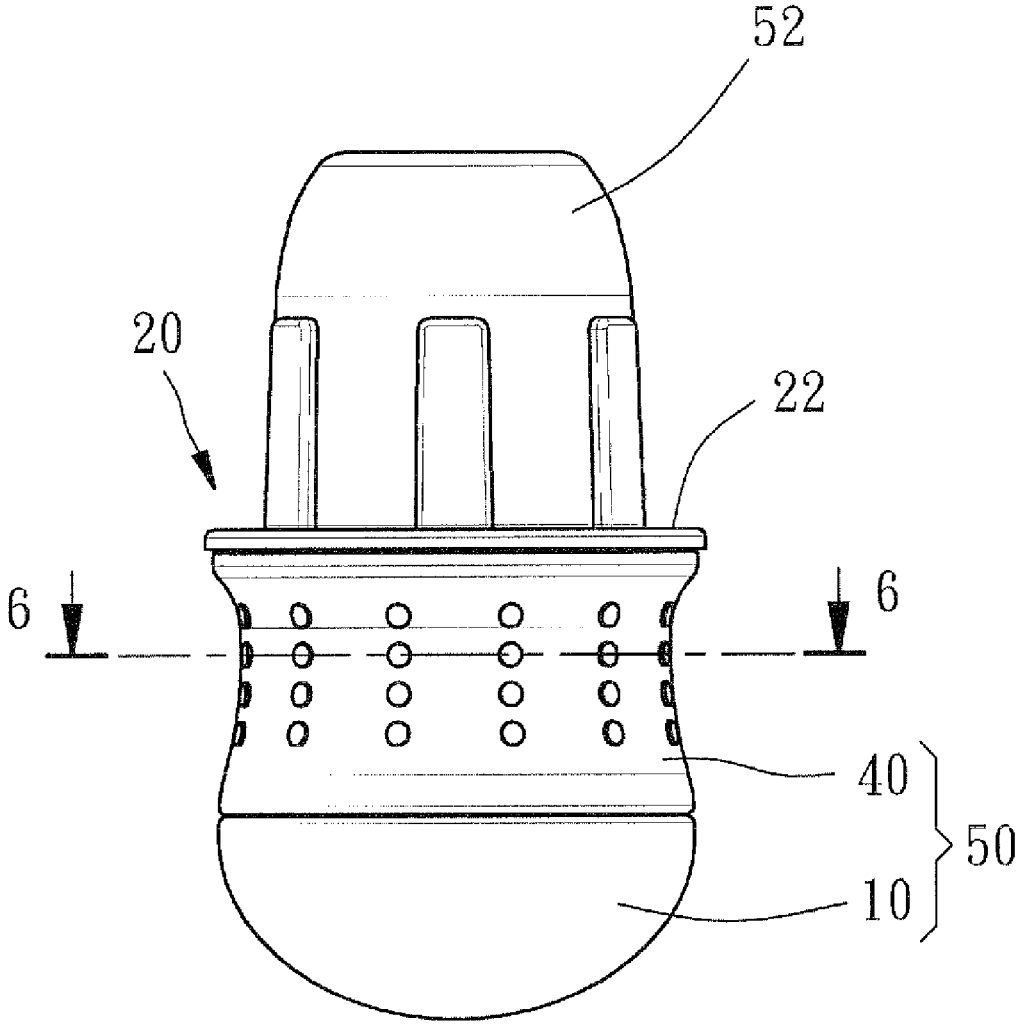
FIG. 4 is a front view of the preferred embodiment of the present invention.

The second reel 52 is a cup-like member, which is greater than the reel 24 to be put on the reel 24. The second reel 52 has a plurality of hooks 54 corresponding to the bores 28 on the rim 22 of the reel device 20 and two suspended arms 56 having a hook 54 at a distal end thereof also. The second reel 52 may be fitted to the reel 24 with the hooks 54 engaged with the bores 28 of the rim 22. To take off the second reel 52, it only has to press the suspended arms 56 to disengage the hooks 54 on the suspended arms 56 with the bores 24 and exert to pull the second reel 52 out. When the stretch film dispenser of the present invention is mounted with the second reel 52, as shown in FIG. 2, the dispenser may dispense 2 inches stretch film roll; and when the second reel 52 is taken off with the reel 24 exposed, the dispenser may dispense 1.5 inches stretch film roll.

Figure 7:
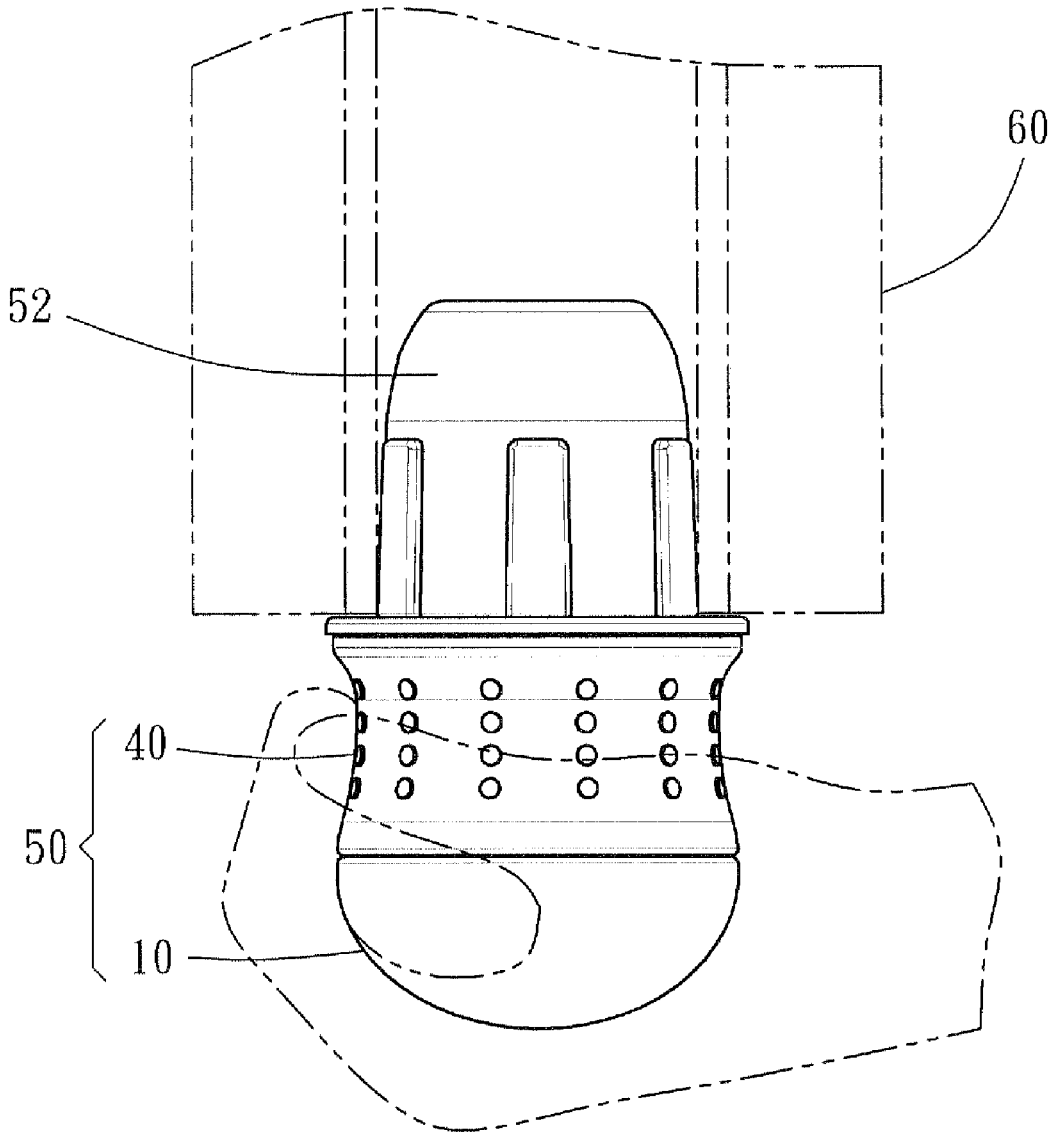
FIG. 7 is a sketch diagram of the preferred embodiment of the present invention, showing the dispenser in operation.

To operate the stretch film dispenser of the present invention, as shown in FIG. 7, one may insert the reel 24 or the second reel 52 into a core of a stretch film roll 60 and hold the holding member 10 with the palm holding the base 10 and with the fingers grasping the brake device 40 to dispense the stretch film for package task. When have to make a turn in the package task, operator may exert his/her fingers to press the brake device 40 that the teeth-like texture will press the friction portion 34 of the reel device 20 to stop the reel 24. As a result, with the brake of the reel 24, the operator may pull to make the stretch film having greater tension to wrap the product tightly.

Figure 6:
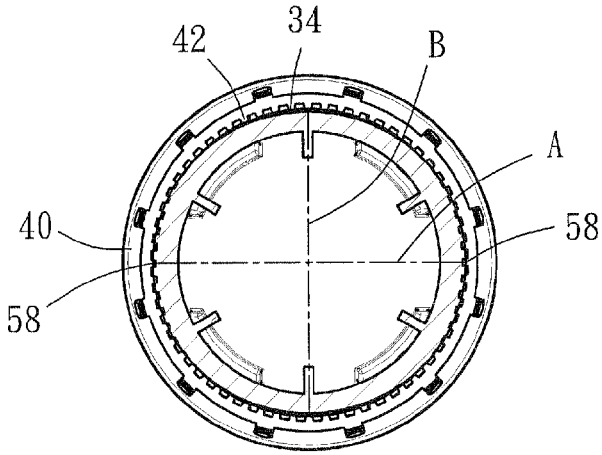
FIG. 6 is a sectional view along the 6-6 line of FIG. 4.

Another character of the present invention is that the friction portion 34 is not a real circle. As shown in FIG. 6, the friction portion 34 has a long axis A and a short axis B, and the long axis A is only 1 mm longer than the short axis B. In other words, the friction portion 34 has two protrusion portions 58 at opposite ends of the long axis A. The brake device 40 will press the protrusion portions 58 inherently to provides the reel 24 a resistance when it is rotating. As a result, the stretch film will be pulled out with a predetermined tension to tightly wrap products. Another advantage of the protrusion portions 58 is that they help in braking the reel device 20. Beside that, operator may use all fingers to press the brake device that may reduce fatigue in operation.

The description above is a few preferred embodiments of the present invention and the equivalence of the present invention is still in the scope of the claim of the present invention.

What is claimed is:

1. A stretch film dispenser, comprising:

a holding member, and a reel being rotatable relative to the holding member, wherein the holding member is capable of being held with a palm by a user to operate the stretch film dispenser, wherein the holding member includes a base and a brake device independent from the base;

wherein the base has an annular wall and the brake device is fitted to the annular wall;

wherein the reel is provided on a reel device and the reel device has a connecting member opposite to the reel;

wherein the annular wall of the base of the holding member has a plurality of gaps to form flexible plates, each flexible plate has a hook, and the connecting member of the reel device has a slot to be engaged with the hooks of the flexible plates; and wherein the brake device has a protrusion at an inner side thereof, and the protrusion of the brake device is engaged with the slot of the connecting member of the reel device.

2. The stretch film dispenser as defined in claim 1, wherein the reel device further has a rim between the reel and the connecting member.

3. The stretch film dispenser as defined in claim 1, wherein the connecting member of the reel device has a friction portion, and the brake device is a flexible tubular member connected to the base and fitted to the connecting member of the reel device corresponding to the friction portion.

4. The stretch film dispenser as defined in claim 3, wherein the brake device has a texture facing the friction portion of the connecting member of the reel device.

5. The stretch film dispenser as defined in claim 3, wherein the friction portion of the connecting member of the reel device has at least a protrusion portion.

6. The stretch film dispenser as defined in claim 1, wherein an outer diameter of the annular wall of the base is greater than an inner diameter of the brake device.

7. The stretch film dispenser as defined in claim 1, further comprising a second reel to be detachably fitted to the reel.

8. The stretch film dispenser as defined in claim 7, wherein the second reel has a hook to be engaged with a bore on the reel.

9. The stretch film dispenser as defined in claim 8, wherein the second reel has a suspended arm having the hook, and the reel has an indentation behind the suspended arm.

10. A stretch film dispenser comprising:

a holding member; and a reel being rotatable relative to the holding member, wherein the holding member is capable of being held with a palm by a user to operate the stretch film dispenser;

wherein the holding member includes a base and a brake device independent from the base;

wherein the reel is provided on a reel device and the reel device has a connecting member opposite to the reel;

wherein the connecting member of the reel device has a friction portion;

wherein the brake device is a flexible tubular member connected to the base and fitted to the connecting member of the reel device corresponding to the friction portion;

wherein the brake device has a texture facing the friction portion of the connecting member of the reel device; and wherein the friction portion of the reel device has a long axis and a short axis, and the long axis is longer than the short axis.

11. The stretch film dispenser as defined in claim 10, wherein a annular wall of the base of the holding member has a plurality of gaps to form flexible plates, each flexible plate has a hook, and the connecting member of the reel device has a slot to be engaged with the hooks of the flexible plates; and wherein the brake device has a protrusion at an inner side thereof, and the protrusion of the brake device is engaged with the slot of the connecting member of the reel device.

12. The stretch film dispenser as defined in claim 11, wherein the connecting member has two annular slots on opposite sides of the friction portion, the brake device has two protrusions at opposite sides of the texture, and the brake device is fitted to the connecting member with the protrusions engaged with the slots of the reel device respectively.

13. The stretch film dispenser as defined in claim 10, wherein the connecting member has two annular slots on opposite sides of the friction portion, the brake device has two protrusions at opposite sides of the texture, and the brake device is fitted to the connecting member with the protrusions engaged with the slots of the reel device respectively.

14. A stretch film dispenser, comprising:

a holding member; and a reel being rotatable relative to the holding member, wherein the holding member is capable of being held with a palm by a user to operate the stretch film dispenser wherein the holding member includes a base and a brake device independent from the base;

wherein the base has a shell and an annular wall at an open end of the shell to form an annular cavity between the shell and the wall, and a plurality of support plates within the annular wall;

wherein the brake device fitted to the annular wall;

wherein the reel is provided on a reel device and the reel device has a connecting member opposite to the reel;

wherein the connecting member of the reel device is inserted into the base between the annular wall and the support plates so that the reel device is connected the base and freely rotatable; and wherein the brake device has a tapering bonding portion on a bottom thereof, the tapering bonding portion is inserted into the annular cavity of the base.

15. The stretch film dispenser as defined in claim 14, wherein the annular wall of the base of the holding member has a plurality of gaps to form flexible plates, each flexible plate has a hook, and the connecting member of the reel device has a slot to be engaged with the hooks of the flexible plates; and wherein the brake device has a protrusion at an inner side thereof, and the protrusion of the brake device is engaged with the slot of the connecting member of the reel device.

16. The stretch film dispenser as defined in claim 15, wherein the connecting member of the reel device has a friction portion;

wherein the brake device is a flexible tubular member connected to the base and fitted to the connecting member of the reel device corresponding to the friction portion;

wherein the brake device has a texture facing the friction portion of the connecting member of the reel device; and wherein the friction portion of the reel device has a long axis and a short axis, and the long axis is longer than the short axis.

17. The stretch film dispenser as defined in claim 14, wherein the connecting member of the reel device has a friction portion;

wherein the brake device is a flexible tubular member connected to the base and fitted to the connecting member of the reel device corresponding to the friction portion;

wherein the brake device has a texture facing the friction portion of the connecting member of the reel device; and wherein the friction portion of the reel device has a long axis and a short axis, and the long axis is longer than the short axis.

* * * * *